United States Patent [19]

Johnson

[11] Patent Number: 4,651,897

[45] Date of Patent: Mar. 24, 1987

[54] PORTABLE PROGRESSIVE CAVITY PUMP

[75] Inventor: Jeffrey B. Johnson, Wheatridge, Colo.

[73] Assignee: Sashco, Inc., Denver, Colo.

[21] Appl. No.: 663,216

[22] Filed: Oct. 22, 1984

[51] Int. Cl.[4] ..... B67D 5/00; F04B 17/06

[52] U.S. Cl. ..... 222/55; 222/626; 222/261; 222/381

[58] Field of Search ..... 222/626, 326, 333, 342, 222/386, 405, 260, 256, 612, 381, 608, 61, 55, 261; 280/47.2; 187/9 R

[56] References Cited

U.S. PATENT DOCUMENTS

| | | | |
|---|---|---|---|
| Re. 24,079 | 10/1955 | Mateer | 222/333 X |
| 2,780,394 | 2/1957 | Walters et al. | 222/333 X |
| 3,031,106 | 4/1962 | Hooker | 222/333 X |
| 3,225,868 | 12/1965 | Barnes | 187/9 R |
| 3,227,326 | 1/1966 | Beamer | 222/333 X |
| 3,282,469 | 11/1966 | Skonberg | 222/386 X |
| 3,305,137 | 2/1967 | Gauthier et al. | 222/626 X |
| 3,578,353 | 5/1971 | Lockhart | 280/47.2 |
| 3,655,212 | 4/1972 | Krass et al. | 280/47.2 X |
| 3,940,065 | 2/1976 | Ware et al. | 222/626 X |
| 4,090,640 | 5/1978 | Smith et al. | 222/260 X |
| 4,132,242 | 1/1979 | Carroll, Jr. | 222/61 X |

OTHER PUBLICATIONS

*Johnstone Pump Company,* selected advertisements from catalog.

*Primary Examiner*—Joseph J. Rolla
*Assistant Examiner*—Nils Pedersen
*Attorney, Agent, or Firm*—Timothy J. Martin

[57] ABSTRACT

A pump apparatus for viscous material adapted to be portable and includes a pair of upright supports defining a rigid framework mounted on a pair of wheels for movement along a support surface, such as a building floor. A platform extends perpendicularly outwardly from the framework and is adapted to support a container of material. A carriage is slideably mounted on a pair of guide rails secured to the framework, and a winch and cable assembly allows an operator to raise and lower the carriage. The carriage mounts a linearly arranged motor, drive shaft and pump, with the pump having a downwardly extending, disk-like follower plate oriented parallel to the platform. When a container is placed on the platform, the carriage may be lowered to insert the follower plate so that it bears against the materials. The motor drives the pump, and, as the material is removed from the container and dispensed through a hose, the weight of the carriage, pump and motor drives the follower plate into the container. The motor is reversible and includes a two level pressure control for automatic operation.

18 Claims, 4 Drawing Figures

PORTABLE PROGRESSIVE CAVITY PUMP

BACKGROUND OF THE INVENTION

This invention relates to pumping apparatus particularly adapted to be portable and especially suited for pumping materials of high viscosity, although it should be understood that the technology described herein lends itself to stationary pump apparatus as well. Pumping devices have been known for a long period of time and, indeed, there have been many developments allowing the pumping devices to be portable. However, typical portable pumping systems are not capable of pumping highly viscous materials such as caulking compounds, sealants, tars, and the like. The reason that these materials present difficulties viscous materials tend to cavitate, that is, to form a cavity as a portion is pulled off of the main body of material. Presence of such open spaces makes a traditional pump inoperative since they depend upon a continuous supply of material to maintain the pumping operation.

In order to pump high viscosity materials, the prior art has relied upon utilization of air rams wherein the pump inlet includes a follower plate that is driven through the material to be pumped by compressed air cylinders in order to prevent cavitation. An example of such a system is a pump sold by Johnstone Pump Company of Troy, Mich. These systems accomplish the object of pumping highly viscous materials, but they have a disadvantage in that they are noisy and require a large capacity, high pressure compressed air source for operation. Such compressed air systems, which can supply a large volume of compressed air at several hundred pounds of pressure, are large, bulky and difficult to transport. Accordingly, the air ram pumps are somewhat suitable in large scale operations, such as factories, where a compressed air system may be centrally located and the air ram pump that it affects location.

In applications where it is desirable to have a portable pump, the air ram pump systems are difficult to utilize since not only must the pump system be moved from location to location, but also a compressed air system must be transported along with the pump. Accordingly, there remains a need for a portable pump device which is adapted to pump highly viscous materials without requiring a source of highly pressured, compressed air. There is a need for such system to be easy to use and economical in production. The present invention accomplishes these needs by its arrangemet of a progressive cavity pump with follower plate and an electric driving motor and drive shaft onto a portable, vertical slide rack which eliminates the need for a compressed air source and still provides the necessary driving force for the follower plate through the viscous material.

SUMMARY OF THE INVENTION

It is an object of the present invention to provide a novel and useful pump apparatus adapted for pumping highly viscous materials.

It is another object of the present invention to provide a pump device for pumping viscous materials without the need of a high pressure, compressed air source.

It is a further object of the present invention to provide a pump device that is moveable on its own support structure and which may slide so that the weight of the pumping apparatus is against the viscous material placed thereunder so as to eliminate cavitation.

It is still a further object of the present invention to provide a unique and nonobvious pump device that may be easily moved from location to location and which is adapted to pump viscous materials from a standardized storage containers in an efficient and relatively clean manner.

The present invention accomplishes these objects by providing an upright support member which is adapted to be oriented in a vertical position on a horizontal support surface such as the floor of a building or a flat surface on the ground. These supports may either be moveable or rigidly affixed to the support surface. A carriage is slideably mounted on guide rails which are connected to the support member so that the carriage slides in an upward and in a downward direction. The main pump mechanism is connected to this carriage and includes an auger with a lower follower plate that may be inserted into viscous materials containers commonly used in the industry. An electric motor is also attached to the sliding carriage on an upper portion thereof. The electric motor is connected to the pump auger by means of a drive shaft assembly so that the pump auger may be turned to pump the material. A mechanism is provided for lowering the carriage so that a follower plate is introduced into a storage container and for raising the carriage to remove the follower plate from the container.

In the preferred embodiment of the present invention, the pump apparatus is mounted on a dolly-support which includes a flat base plate and a pair of elongated, vertical supports which are interconnected by cross arms so as to provide the rigid framework. An axle carries a pair of wheels and is mounted near the bottom of the upright supports so that the support framework may be tilted and rolled on the wheels for ease in moving the pump apparatus from one location to another. A pair of guide rails, each in the form of a cylindrical rod attached to the upright supports, and an H-shaped carriage is mounted sidewise on these rails so that each leg of the H-shaped configuraton extends one rail to the other so that the carriage may slide along the rails parallel to the vertical supports. A hand winch and cable system is provided to raise and lower the carriage. The winch is mounted to the support framework on a side thereof opposite the carriage with the cable system being threaded over a pulley in an upper portion of the support framework and atached to the carriage. This winch system has a releaseable latch so that the carriage may be released whereby it may freely slide downwardly along the guide rails and the force of gravity.

The pump assembly is arranged in a linear manner with the follower plate being located at the lowermost portion. A reversible electric motor is attached to the upper portion of the carriage so that its rotor shaft is oriented in a vertical direction. A drive shaft assembly mechanically interconnects the rotor shaft of the electric motor and the auger element which is located in a pump auger housing. The drive shaft assembly includes a sealed drive shaft bearing which is mechanically connected to the auger element, a helical gear reduction box mechanically connected to the motor shaft and a flexible coupling mechanically interconnecting the gear reduction box output and the drive shaft bearing. All of these elements are arranged in a vertical line between the pump auger and the motor and all are located in a line above the follower plate. Thus, the center of mass of the pump assembly is positioned over the base plate so that the support framework is held vertically and, since the pump assembly is attached directly to the carriage, the full weight of the carriage and pump assembly bears on the viscous material in a container placed between the base plate and the follower plate.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention relates to pump apparatus, and specifically to a pump apparatus adapted to pump materials of relatively high viscosity in a manner that prevents cavitation of those viscous materials. While the preferred embodiment of the present invention is adapted to be portable so that it may be moved from location to location, the general concepts of this invention are completely applicable to stationary pumps where it is desired to remove the requirement of a high pressure compressed air source.

Figure 1:
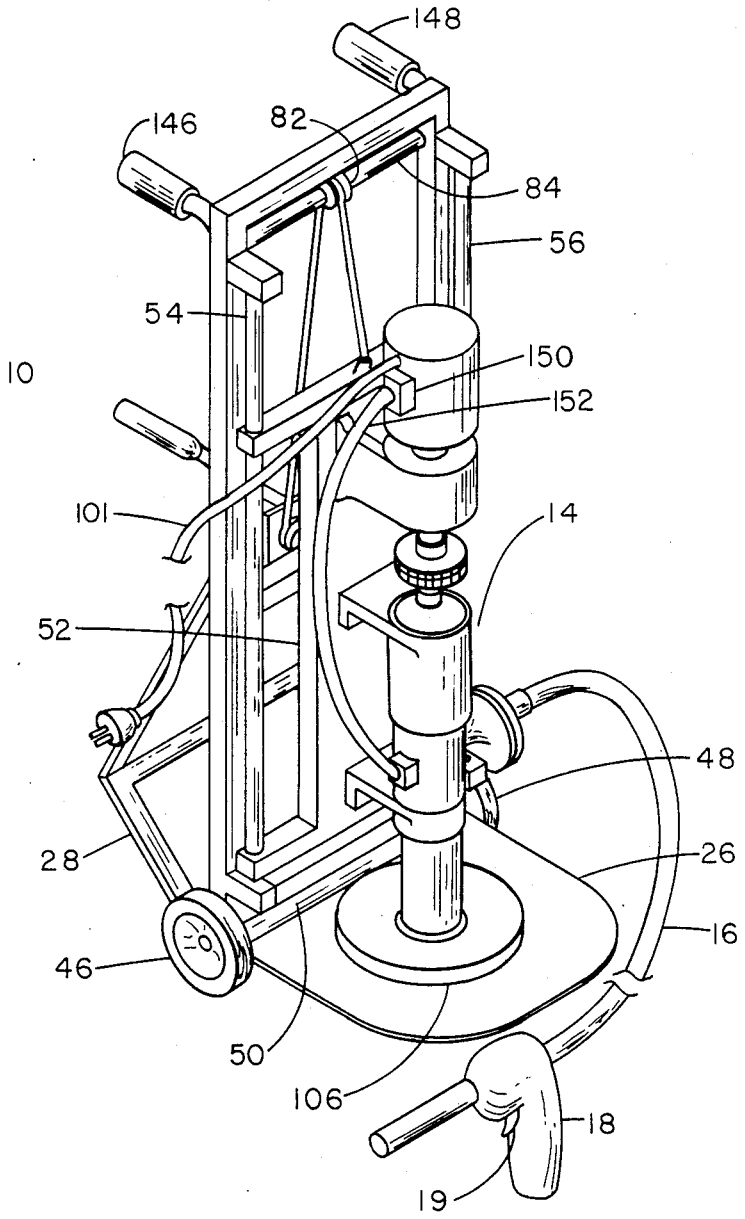
FIG. 1 is a perspective view of the pump apparatus according to the preferred embodiment of the present invention shown with the follower plate in a lowered position.

As shown in FIG. 1, pump apparatus 10 includes a dolly-like support framework 12 that carries a pump assembly 14. A dispensing hose 16 is releaseably attached to pump assembly 14 and includes a dispensing attachment such as gun 18 outletting the pump material.

Figure 2:
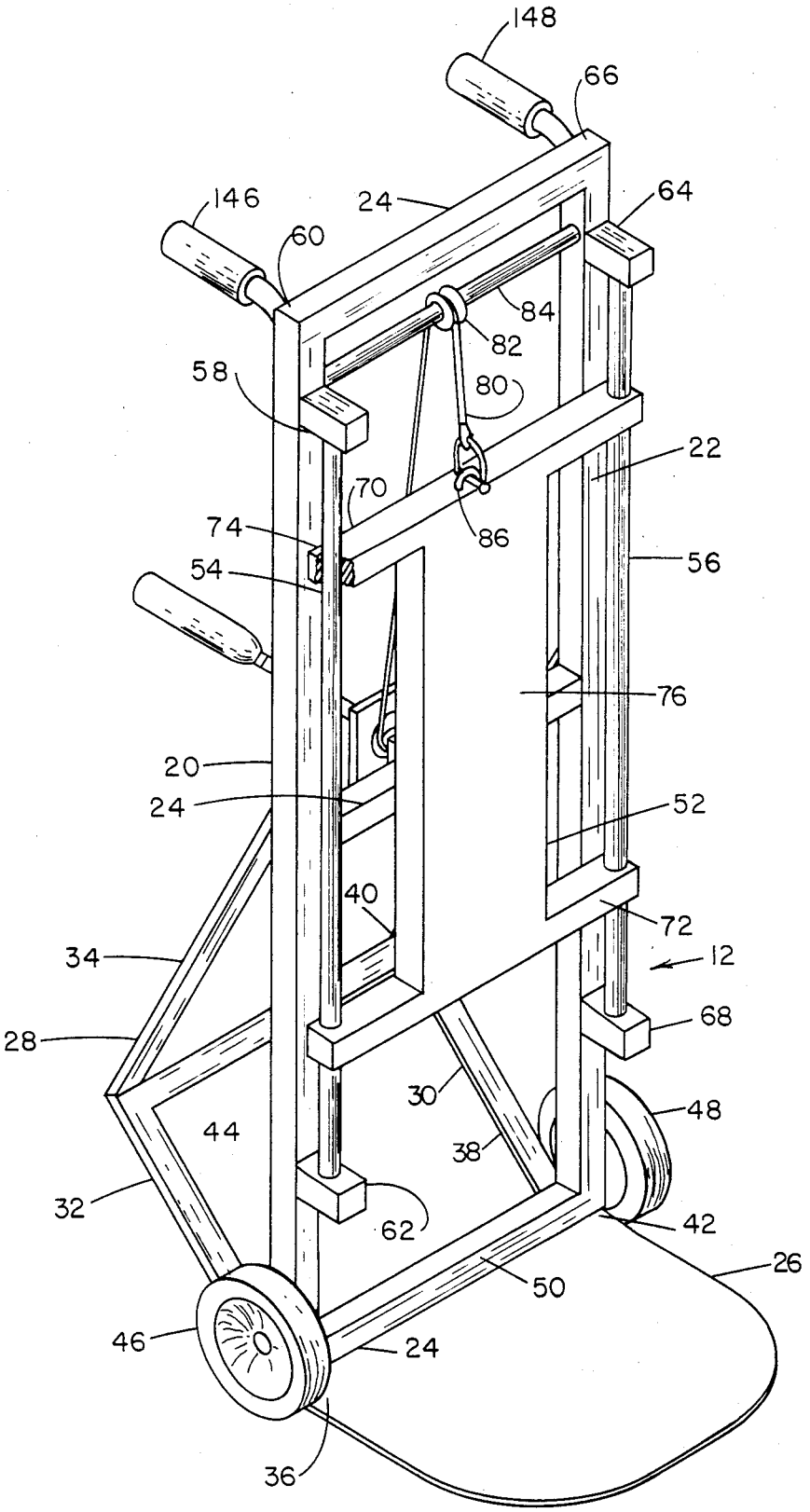
FIG. 2 is a perspective view of the support framework for the pump assembly according to the preferred embodiment of the present invention with a portion of the carriage partially broken in cross section.

Framework 12 is shown in greater detail in FIG. 2. Framework 12 includes a pair of upright support members 20 and 22 which are preferably elongated rectangular steel tubes which are positioned in parallel spaced apart relation to one another and are interconnected by a plurality of cross arms 24 which extend between upright supports 20 and 22. Cross arms 24 are attached to supports 20 and 22 by welding their ends of cross arms 24 to the upright supports. A container support platform or base plate 26 is affixed at a lower edge of framework 12 at ends 36 and 42 of suports 20 and 22, respectively. Base plate 26 extends in a plane perpendicular to upright supports 20 and 22 in it so that it will rest in a generally horizontal position when framework 12 is placed on a horizontal support surface.

A pair of brackets 28 and 30 are L-shaped in configuration and are mounted to upright supports 20 and 22, respectively, on a side of framework 12 opposite base plate 26. Bracket 28 includes a lower leg 32 which has one end that is connected approximately 120° to upper leg 34. The other end of leg 32 is connected to lower end 36 of support 20 while the other end of leg 34 is attached to a mid-portion of support 20. Similarly, bracket 30 has a lower leg 38 and an upper leg 40 which have ends attached to one another at approximately 120°. Leg 38 is also attached at its other end to lower end 42 of upright support 22 while leg 40 is attached at its other end to a mid-portion of support 22. Brackets 28 and 30 are rigidly interconnected to one another by cross arm 44.

An axle 50 is rotatably journaled between the lower ends of support members 20 and 22. Axle 50 mounts a pair of wheels 46 and 48 so that framework 12 may be conveniently rolled from one location to another. Wheels 46 and 48 along with base plate 26 hold framework 12 in a generally vertical position when pump apparatus 10 is in use.

A carriage 52 is slideably mounted to framework 12 and is positioned on a common side of supports 20 and 22 as base plate 26. Specifically, carriage 52 is slideably received by a pair of guide rails 54 and 56 mounted to framework 12. Guide rail 54 is rigidly attached to support member 20 in a generally parallel spaced apart relation by a first mounting block 58 attached to upper end 60 of support 20 and a second mounting block 62 attached at a mid-portion of support 20. Similarly, guide rail 56 is attached to support 22 by means of a first mounting block 64 attached at one end 66 of support 22 and a second mounting block 68 attached to the mid-portion of support 22.

Carriage 52 is generally H-shaped in configuration and is mounted sideways so that legs 70 and 72 extend between guide rails 54 and 56. The ends of legs 70 and 72 include bores, such as bore 74, so that legs 70 and 72 slideably receive guide rails 54 and 56 so that carriage 52 may be raised and lowered therealong. Carriage 52 has a main body 76 which extends between legs 70 and 72 and is operative to mount pump assembly 14 thereon. It should be understood, though, that other shapes of carriages 52 would be completely suitable. To facilitate raising and lowering carriage 52, a hand operated winch and cable assembly 78 is mounted to framework 12 opposite carriage 52. Winch assembly 78 includes a cable 80 that is trained over a rotatable pulley 82 located on a rotatable pulley axle 84 which extends between upper ends 60 and 66 of supports 20 and 22, respectively. The end of cable 80 opposite winch assembly 78 is attached to mounting ring 86 secured to carriage 52.

Figure 3:
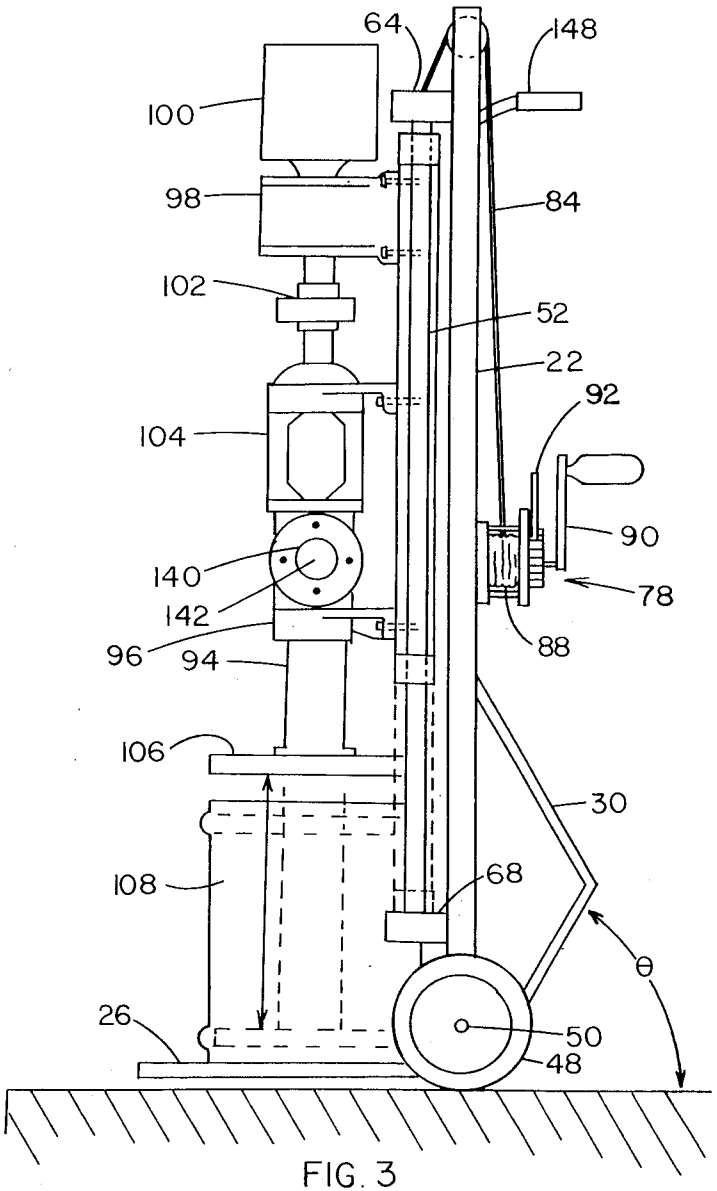
FIG. 3 is a side view in elevation of the pump apparatus shown in FIG. 1 shown with the follower plate in a raised position and with a viscous material storage container with which this apparatus is used.

As is shown best in FIG. 3, winch assembly 78 includes a cable drum 88 which reels in and lets out cable 80. A crank 90 permits manual turning of cable drum 88. Winch assembly 78 is preferably a standard two-way ratchet winch including a release lever 92 that is operative to elease drum 88 so that cable 80 may freely unwind and allow carriage 52 to slide without resistance along rails 54 and 56. It should be appreciated, however, that other lift means could be utilized in place of winch assembly 78.

As noted above, pump assembly 14 is mounted on carriage 52 for common movement therewith. Pump assembly 14, as is shown in FIGS. 1 and 3, includes a pump auger 94 attached to carriage 52 by mounting bracket 96 adjacent its lower edge portion. An in-line helical gear reduction box 98 is mounted on upper end portion of carriage 52 and supports an electrical motor 100 in a position above gear box 98. Motor 100 includes a standard motor shaft that extends into gear box 98. Motor 100 is preferably three-fourth horse power, totally enclosed fan-cooled motor and is preferably of a type that can be driven either by 115 or 230 volt circuits. To this end, motor 100 has an electrical power cord 101 of the standard type. Motor 100 mechanically drives pump auger 94 through a drive shaft assembly which includes gear reduction box 98, the output of which is connected to a flexible coupling 102. A sealed drive shaft bearing 104 is mechanically connected on one side to pump auger 94 and on its other side to flexible coupling 102. It should thus be appreciated that pump auger 94 and motor 100 are arranged in a vertical line with gear reduction box 98, flexible couple 102 and sealed drive shaft bearing 104 also being arranged in this vertical line.

Pump auger 94 mounts a follower plate 106 at its lowermost end. Follower plate 106 is configured to correspond to viscous material containers and may take any desired shape. Preferably, follower plate 106 is formed of aluminum configured as a disk sized to be received by a standard cylindrical storage containers of viscous materials, such as five gallon buckets. Follower plate 106 is oriented in a plane generally parallel to base plate 26 so that a container 108 may be positioned therebetween. Container 108 is a standard five gallon straight sided pail used in the industry to store caulking compounds and the like. Accordingly, follower plate 106 is sized to be slightly smaller than the diameter of container 108 and has a neoprene gasket 110 extending around its circumferential edge to provide a seal between follower plate 106 and the internal side wall of container 108.

Figure 4:
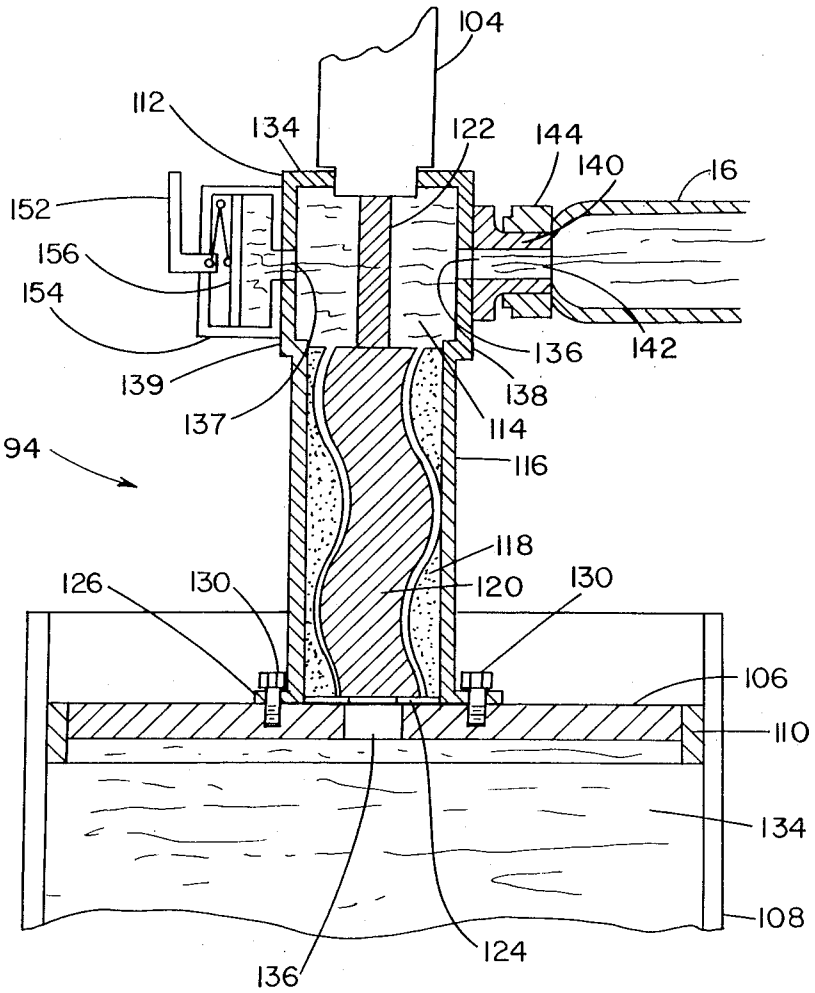
FIG. 4 is a front view in partial cross section of pump auger, follower plate and viscous material storage container according to the preferred embodiment of the present invention.

The structure of follower plate 106 and pump auger 94 is seen in greater detail in FIG. 4. Here, pump auger 94 is shown to include an auger housing 112 which has a housing portion 114 from which extends a longitudinal sleeve 116. A spiral rubber stator 118 is received in sleeve 116, and an auger element 120 is rotatably journaled on an axle 122 which extends longitudinally through housing 112. Auger element 120 is positioned within stator 118 as is known in the art. Thus, axle 122 may be rotated by motor 100 acting through the drive shaft assembly.

Sleeve 20 has an open end 124 located opposite housing portion 114. A circumferential attachment flange 126 which extends around sleeve 116 adjacent open end 124 so that sleeve 116 may be attached to follower plate 106 by means of screws 130. Follower plate 106 has a centrally located bore or opening 132 that allows viscous material 134 in container 108 to pass through follower plate 106 and into auger housing 112. Thus, it should be appreciated that open end 124 defines an auger inlet for pump auger 94. An auger outlet opening 136 is formed in a side wall 138 of housing portion 114, and a quick release coupling 140 is mounted to side wall 58 so that passageway 142 of coupling 140 is in fluid communication with outlet 136. Dispensing hose 16 may then be attached and removed from coupling 140 by complimentary quick release attachment element 144. Dispensing gun 18 may be of any standard type commercially available, but is preferably of a type having an activation/deactivation lever 19 located thereon.

The operation of pump apparatus 10 can now be appreciated more fully from the foregoing description. Specifically, pump apparatus 10 may be moved from location to location by rolling pump apparatus 10 along wheels 46 and 48 with an ordinary dolly. However, in order to prevent pump apparatus 10 from tipping over and to facilitate movement of the pump apparatus up and down stairways, brackets 28 and 30 are provided. Thus, it should be appreciated that legs 32 and 38 of brackets 28 and 30 are oriented at an angle $\theta$ with respect to base plate 26, as is shown in FIG. 3. This angle allows framework 12 to be tipped from the vertical orientation for movement, but brackets 28 and 30 prevent framework 12 from being tipped at too great of an angle so that it may tip over. To facilitate the movement of pump apparatus 10, a pair of manual hand grips 146 and 148 are attached to the upper end of framework 12 on supports 20 and 22, respectively.

Once pump apparatus is moved to the desired location, it is set in an upright position so that it rests on base plate 26 and wheels 46 and 48. It should be appreciated that the center of gravity of pump apparatus 10 is located above base plate 26 which also provides a stable support for container 108. If necessary, the operator utilizes winch assembly 78 to raise carriage 52 so that follower plate 106 is moved away from base plate 26 a sufficient distance to allow container 108 to be positioned under follower plate 106. The operator then lowers carriage 52 by operating winch assembly 78 until follower plate 106 contacts viscous material 134 in container 108 and rests thereon. The operator may then release ratchet lever 92 so that cable 80 no longer supports carriage 52. It should thus be appreciated that the full weight of carriage 52 along with the weight of pump assembly 14 completely bears against the viscous material in container 108. This force of gravity thus presents cavitation of material 134 and, as material 134 is removed from container 108, carriage 52 descends along guide rails 54 and 56 so that follower plate 26 moves downwardly into container 108.

To this end, it should be understood that mounting blocks 62 and 68 also operate to allow follower plate 106 to move into closely spaced relation to base plate 26 so that substantially all of the material may be removed from a container 108 placed thereunder. Mounting blocks 62 and 68 thus provide a limit stop for carriage 52 so as to prevent the weight of pump assembly 14 from bearing on follower plate 106 and flange 26. Once material 134 has been pumped from container 106, the operator moves release lever 92 into a latched position and turns crank 90 so that cable drum 88 rotates to reel in cable 80 causing carriage 52 to move upwardly until follower plate 106 exits container 108.

To enhance the operation of pump apparatus 10 and to increase the safety to an operator of dispensing attachment 18, motor 100 is provided with an electrical switch 150 is attached by electrical lead 152 to a pressure sensor 154. This eliminates the need for the operator of dispensing gun 18 to have an electric on/off switch secured to gun 18 or carried with him. Pressure sensor 154, as is shown in FIG. 4, is a diaphragm sensor including a diaphragm 156 which operates electrical contacts in response to the pressure of the viscous fluid 134 in housing portion 114. To this end, a pressure port 137 is formed in a side wall 139 of housing portion 114 so as to allow a small portion of viscous material 134 to enter pressure sensor so that its presence may be monitored.

Pressure sensor 154 is a standard two-way control having an upper limit and a lower limit that may be selectively set by the operator. When motor 100 is activated, it runs until the upper limit of sensor 154 is reached afterwhich motor 100 automatically shuts off. When material is dispensed out of gun 18, this pressure drops until the lower limit is reached. When the lower pressure limit is reached, motor 100 automatically starts to raise the pressure in auger housing 12. Thus, motor 100 maintains the pressure between the upper and lower pressure limits.

Also, as noted above, motor 100 is preferably a reversible motor, and accordingly, gear box 98 should be a reversible reduction gear box as well. This reversing feature allows the operation of pump apparatus 10 to be less messy and moreover, allows the operator to reduce the hose pressure thereby enabling a quicker hose disconnect in a safe manner without releasing excess material. When the desired amount of material has been removed from a container 108, and prior to disconnecting dispensing hose 16, motor 100 is reversed for a few moments so that auger element 120 is reversed. This procedure drives material out of hose 16 and housing portion 114 back into container 108. After this brief moment of reverse operation, motor 100 is shut off and hose 16 may be disconnected from coupling 140. Since most of the material is removed at the fluid regions adjacent coupling 140, less mess is created when hose 16 is removed.

From the foregoing, it should be appreciated that the preferred embodiment of the present invention has been described in some detail as a portable pump apparatus. However, it is not a requirement that this pump apparatus be portable but could be rigidly affixed by mounting support members 20 and 22 in a vertical manner on any support service such as a concrete floor or the like. To this end also, it should be understood that base plate 26 is not an absolute requirement of the system but rather facilitates a self-included support plate for container 108. Base plate 26 may be omitted and container 108 simply set on the horizontal support surface on the ground or floor of a building although base plate 26 is helpful when it is desired to transport container 108 along with pump apparatus 10 without removing follower plate 106 from container 108. Should it be desirous that greater weight be placed on pressure plate 106 as it bears against material 134, additional weights may be attached to carriage 52 or carriage 52 could be constructed of heavier material, such as steel.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A pump apparatus adapted to pump a relatively highly viscous material subject to cavitation from a container while reducing cavitation of the material in the container, comprising:

an upright support member adapted to be oriented in a generally vertical position on a horizontal support surface;

a carriage having an upper portion and a lower portion;

guide rail means for slideably mounting said carriage to said support member for upward and downward movement therealong, said guide rail means including rail elements that slideably engage the upper and lower portions of the carriage to positively support said carriage during movement therealong;

a pump auger secured to the lower portion of said carriage and including an auger housing having an auger inlet and an auger outlet and including an auger element positioned in said auger housing;

auger drive means secured to the upper portion of said carriage for rotatably driving said auger element in the auger housing, said auger drive means including a drive shaft assembly mechanically connected to and aligned with said pump auger;

a follower plate attached to a lower end of said pump auger opposite said drive shaft assembly and oriented in a generally horizontal plane when said upright support member is oriented vertically, said follower plate configured for close-fitting insertion into said container so that the follower plate bears against the viscous material, said follower plate having a central port therethrough in fluid comunication with said auger housing, said pump auger, said auger drive means and said drive shaft assembly being axially aligned with one another to press said follower plate downwardly against said viscous material under gravity free-fall; and lift means for selectably raising and lowering said carriage along said guide rail means and including release means for releasing said carriage whereby the follower plate bears against the viscous material under gravity freefall in order to advance said follower plate into the container so that the material is forced through said port and said auger inlet and is driven by said auger element to be expelled through said auger outlet.

2. A pump apparatus according to claim 1 including an axle mounted at a lower end of said upright support member and a pair of spaced-apart wheels on said axle on opposite sides of said upright support member whereby said pump apparatus may be rolled along said support surface.

3. A pump apparatus according to claim 2 including a container support plate attached to said upright support member and extending outwardly therefrom in a plane generally parallel to the plane of said follower plate whereby the container may be placed on and supported by said support plate as the follower plate advances therein, said support plate adapted to rest directly on said support surface.

4. A pump apparatus according to claim 3 wherein said upright support member includes a pair of elongated, spaced-apart parallel frame members rigidly interconnected by a plurality of cross arms attached therebetween, said guide rail means including a pair of parallel elongated rails, each rail secured to a respective frame member, (and slideably receiving a portion of) said upper and lower portions of said carriage telescopically receiving said guide rails whereby said carriage is slideably mounted on and guided by said rails.

5. A pump apparatus according to claim 4 wherein said carriage is H-shaped in configuration and mounted sideways on said rails with each leg of the carriage extending from one rail to the other rail.

6. A pump apparatus according to claim 5 wherein each end of each leg of said carriage has a bore formed therethrough, said rails being slideably journaled in said bores.

7. A pump apparatus according to claim 3 including at least one anti-tip bracket secured to said upright support member on an opposite side thereof than said support plate and operative to limit the angle that the support member may make with the horizontal surface, said axle positioned on said upright support whereby the circumferential surfaces of said wheels are oriented immediately below said support plate.

8. A pump apparatus acording to claim 1 wherein said lift means includes a ratchet winch secured to said upright support member, a pulley rotatably journaled to an upper portion of said upright support member, and a cable attached at a first end to said carriage, trained over said pulley and attached at a second end to said winch whereby operation of said winch moves said carriage, said release means including a trip latch on said winch.

9. A pump apparatus according to claim 1 wherein said auger drive means includes an electric motor.

10. A pump apparatus according to claim 9 wherein said electric motor is reversible.

11. A pump apparatus according to claim 9 wherein said drive shaft assembly includes a helical gear reduction box mechanically connected to said motor, a sealed drive shaft bearing mechanically connected to said auger element, and a flexible coupling mechanically interconnecting said gear reduction box and said drive shaft bearing, said electric motor, gear reduction box, flexible coupling and drive shaft bearing all being linearly arranged and aligned vertically with said pump auger.

12. A pump apparatus according to claim 1 wherein said pump auger comprises a progressive cavity pump.

13. A pump apparatus accordingly to claim 1 wherein said follower plate includes a radially outwardly projecting, circumferential sealing gasket.

14. A pump apparatus according to claim 1 including pressure sensing switch means for monitoring the viscous pressure of the viscous material at said auger outlet and having means for setting an upper pressure limit and a lower pressure limit, said switch means operative to control said auger drive means whereby said auger drive means is deactivated when the fluid pressure reaches said upper pressure limit and is reactivated when the fluid pressure falls below said lower pressure limit.

15. A pump apparatus according to claim 1 including a flexible hose having a first hose end releaseably connected in fluid communication to said auger outlet and having a second hose end releaseably connected to dispensing means for discharging said viscous fluid from said hose.

16. A pump apparatus according to claim 15 including shut-off means on said dispensing means for activating and deactivating said end dispensing means to allow and prohibit fluid discharge respectively therefrom.

17. A portable pump apparatus adapted to pump a relatively high viscous material subject to cavitation from a container, comprising:

a main frame including a pair of elongated support members rigidly connected in parallel relation to one another by a plurality of cross arms and defining a frame plane, said support members adapted to be positioned in a generally vertical relation to a horizontal support surface;

a base platform rigidly attached to said main frame at a lower end thereof, said platform extending laterally outwardly from said main frame in a generally perpendicular relation to said frame plane and operative to support said container and to orient said support members in a vertical relation on said horizontal support surface;

a pair of wheels rotatably journaled to said first end of said main frame and operative to engage said support surface to allow said main frame to be moved therealong;

a pair of guide rails mounted on said main frame in spaced apart parallel relation to one another and on a common side with said base platform;

a carriage slideably mounted on said guide rails;

a pump assembly secured to said carriage and including a pump auger, a drive shaft and a drive motor arranged axially with respect to one another along a force line and generally parallel to said guide rails, said pump auger being located closest to said platform, said carriage being positioned between said pump assembly and said main frame whereby said force line is generally centered over said base platform;

a follower plate configurd to correspond to the cross section of said container and mounted on said pump auger in parallel facing relation to said platform and sized for insertion into said container; and lift means for selectively moving said carriage whereby said follower plate may be advanced into and out of said container when said support members are positioned in a generally vertical position and said container is placed on said platform and including release means for releasing said carriage whereby the pump assembly acting on said follower plate under gravity free-fall causes said follower plate to bear against said viscous material along said force line under the free-fall weight of said carriage and pump assembly.

18. A pump apparatus adapted to pump a relatively highly viscous material subject to cavitation from a container while reducing cavitation of the material in the container, comprising in combination:

an upright support member adapted to be oriented in a generally vertical position on a horizontal support surface;

a carriage having an upper portion and a lower portion;

a pair of parallel guide rails adapted to slideably mount said carriage to said support member for upward and downward movement therealong, said carriage having bores through said upper and lower portions such that the bores telescopically receive said guide rails whereby said carriage is positively supported for sliding movement along said guide rails;

a pump secured to the lower portion of said carriage and including a pump housing and pumping mechanism element positioned in said housing, said housing having an inlet and an outlet;

pump drive means secured to the upper portion of said carriage for driving said pumping mechanism, said pump drive means including a drive shaft assembly mechanically connected to said pump;

a follower plate attached to a lower end of said pump opposite said drive shaft assembly and oriented in a generally horizontal plane when said upright support member is oriented vertically, said follower plate configured for close-fitting insertion into said container so that the follower plate bears against the viscous material, said follower plate having a central port therethrough in fluid communication with said pumping mechanism element, said pump, said pumping mechanism element, said pump drive means and said drive shaft assembly being axially aligned with one another to press said follower plate downwardly against said viscous material under gravity free-fall; and lift means for selectably raising and lowering said carriage along said guide rail means and including release means for releasing said carriage whereby the follower plate bears against the viscous material under gravity free-fall in order to advance said follower plate into the container so that the material is forced through said port and said inlet and is driven by said pumping mechanism element to be expelled through said outlet.

* * * * *